US005393366A

United States Patent [19]

Bell

[11] Patent Number: 5,393,366

[45] Date of Patent: Feb. 28, 1995

[54] ALIGNING AND TABBING METHOD AND APPARATUS

[75] Inventor: David L. Bell, Oquawka, Ill.

[73] Assignee: Profold, Inc., Sebastian, Fla.

[21] Appl. No.: 986,261

[22] Filed: Dec. 7, 1992

[51] Int. Cl.[6] ..... B31F 5/00

[52] U.S. Cl. ..... 156/443; 271/225; 271/251; 156/212; 156/216; 156/475; 156/477.1

[58] Field of Search ..... 271/251, 225; 156/216, 156/443, 475, 476, 477.1, 479, 486, 212

[56] References Cited

U.S. PATENT DOCUMENTS

| | | | |
|---|---|---|---|
| 2,145,334 | 1/1939 | Bergstein | 156/443 |
| 2,781,818 | 2/1957 | Beckman | 156/463 |
| 4,183,779 | 1/1980 | Barber | 156/542 |
| 4,278,488 | 7/1981 | Kopacz | 156/216 |
| 4,588,463 | 5/1986 | Barber | 156/216 |
| 4,606,715 | 8/1986 | Larson | 156/556 |
| 4,669,719 | 6/1987 | Fratangelo | 271/251 |
| 4,701,238 | 10/1987 | Boucher | 156/216 |
| 4,750,966 | 6/1988 | Koller | 156/216 |
| 5,114,137 | 5/1992 | Olson | 271/251 |

FOREIGN PATENT DOCUMENTS

| | | | |
|---|---|---|---|
| 1470940 | 12/1975 | United Kingdom | 345/74 |

*Primary Examiner*—W. Gary Jones
*Assistant Examiner*—Mark De Simone
*Attorney, Agent, or Firm*—James B. Middleton

[57] ABSTRACT

Articles such as mail are rotated 90°, aligned at one edge, and tabs applied to the edge and wrapped around the edge. The article is carried on a belt, and a stop halts forward movement of the article as the article is received under a pivot ball and a drive ball that holds the article against the belt. The driving force causes the article to rotate about the pivot until the article is free to move further on the belt. Angled belts receive the article and urge it against an alignment fence. A tab is dispensed onto the article, and a twisted belt provides a warped surface for wrapping the tab around the edge of the article. Pressure belts press the tab firmly into position.

6 Claims, 2 Drawing Sheets

A
21
21
48
54
20
19
16
18
15
13
14
14
14
11
12
10
22
26
34
25
29
24
14
14
13
12
10
22
35
26
34
28
32
30
29
31
10

ALIGNING AND TABBING METHOD AND APPARATUS

BACKGROUND OF THE INVENTION

1. Field of the Invention

This invention relates generally to article handling, and is more particularly concerned with a method and apparatus for aligning an edge of articles and placing one or more tabs on the aligned edge.

2. Discussion of the Prior Art

It has long been known to utilize adhesive tabs or the like to close the loose edges of a paper, brochure or the like to send the article through the mail. The sealing of the loose edge is desirable both to provide some confidentiality to the mail, and to allow easier feeding of the article without separating the article during machine feeding. While such tabs have long been utilized, with the more recent attempts at virtually full automation of the post office it has become more important to apply tabs quickly and efficiently so the articles can be handled by the automated equipment.

One of the difficulties in applying tabs in the past has been in appropriate alignment of the article before dispensing the tabs onto the article. An article coming from one piece of machinery may require rotating 90° to be aligned properly to receive tabs. Such rotation, with precise alignment, has been difficult to achieve, especially at a reasonable rate of speed. After the article has been rotated, an edge must be carefully aligned, then the article fed into the tabbing apparatus. The prior art has not provided apparatus to be both efficient and fast in applying these tabs.

SUMMARY OF THE INVENTION

The present invention provides a method and apparatus for receiving an article, rotating the article 90° and aligning one edge of the article with a predetermined line. After the article is appropriately aligned, at least one tab is dispensed onto the article, the tab being approximately half on the article and half extending beyond the article. Means are then provided for holding the article while a warped surface urges the tab around the edge of the article to seal the tab tightly to the article. It is contemplated by the present invention that a plurality of tabs may be applied to each article if desired.

BRIEF DESCRIPTION OF THE DRAWINGS

These and other features and advantages of the present invention will become apparent from consideration of the following specification when taken in conjunction with the accompanying drawings in which.

DETAILED DESCRIPTION OF THE EMBODIMENT

Figures 1, 2, 3:
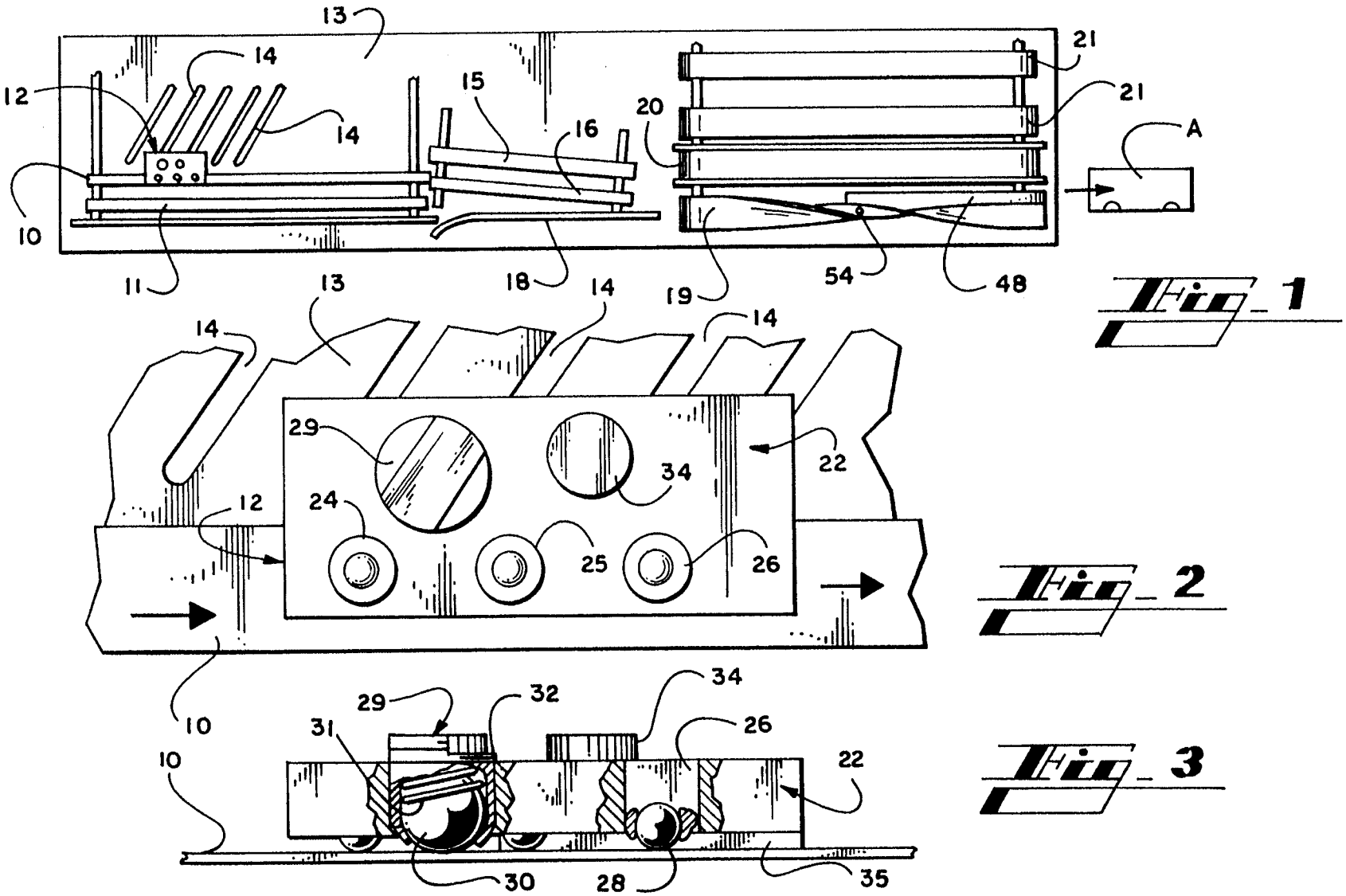
FIG. 1 is a top plan view showing aligning and tabbing apparatus made in accordance with the present invention.
FIG. 2 is an enlarged top plan view showing the means for rotating articles.
FIG. 3 is a front elevational view of the apparatus shown in FIG. 2, portions being broken away to illustrate the construction thereof.

Referring now more particularly to the drawings, and to that embodiment of the invention here presented by way of illustration, FIG. 1 shows, in somewhat schematic form, the feed table for supporting the apparatus of the present invention. At the left hand side of FIG. 1, it will be seen that there are in-feed belts 10 and 11 having the turning apparatus 12 adjacent thereto. The feed table 13 defines a plurality of slots 14 to allow the turning device 12 to be mounted on the table at the appropriate location for the specific articles being fed and turned by the device 12. The articles, after turning, continue along the belts 10 and 11 to aligning belts 15 and 16. It will be seen that the aligning belts 15 and 16 are disposed at an angle with respect to the alignment fence 18. Due to this angular arrangement, it will be understood that articles traveling from the belts 10 and 11 and onto the belts 15 and 16 will be urged snugly against the fence 18 to assure that one edge of the article is properly aligned.

As will be discussed in more detail hereinafter, one or more tabs will be applied to the article, then the article will move beneath the twisted belt 19 and the hold-down belt 20. There are additional belts 21 to carry the article through the tab sealing mechanism.

Attention is now directed to FIGS. 2 and 3 of the drawings for a full understanding of the turning device 12. FIG. 2 shows a portion of the belt 10 along with the turning device 12, and portions of the mounting slots 14. The turning device 12 includes a generally rectangular block 22 defining a plurality of openings therethrough, the openings being designated at 24, 25 and 26.

The three openings 24, 25 and 26 are aligned with one another, and are generally centered over the belt 10. Each of the openings 24, 25 and 26 includes a metal ball such as the ball 28 shown in FIG. 3 of the drawings. The balls, such as the ball 28, rest on the belt 10 simply with their own weight.

There is an article pivot device generally designated at 29, the article pivot device including a relatively large ball 30 held down by a spring 31. The ball 30 and spring 31 are within a threaded container 32. As is best shown in FIG. 3 of the drawings, if the container 32 is rotated, the threads will cause the container 32 to move down towards the table 13 to exert greater pressure against the table. Rotation of the container 32 in the opposite direction will lift the container and reduce the pressure on the ball 30.

There is an anchor member 34 that passes through the block 22 and engages one of the slots 14 to secure the block 22 to the table 13. It will be noticed that the block 22 includes a stanchion 35 which supports the majority of the block 22 above the table 13 so articles can fit beneath the block 22.

Figure 4:
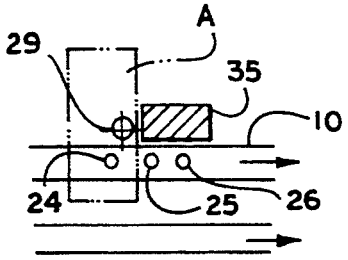
FIGS. 4, 5 and 6 are schematic illustrations showing operation of the turning device shown in FIGS. 2 and 3.

Looking then at FIGS. 4, 5 and 6, the operation of the device will be described. Starting with FIG. 4, the article is designated at A and is shown in phantom, The article is carried on the belts such as the belts 10 and 11, and the article extends beneath the block 22 until it engages the stanchion 35. At this point, it will be seen that the pivot device 29 has engaged the article A; and, the article A is between the ball 24 and the belt 10. It should be understood that the belts 10 and 11 are running continuously in the direction of the arrows shown in FIG. 4; therefore, there will be a driving force to move a portion of the article A to the right as viewed in FIG. 4. Since the pivot device 29 tends to hold the article in position, the article will tend to be rotated by the driving force at 24 acting around the pivot 29.

Figure 5:
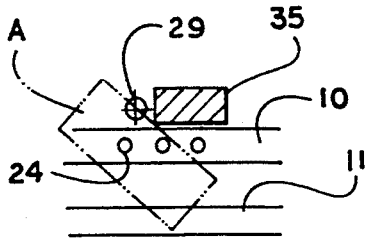
Figure 6:
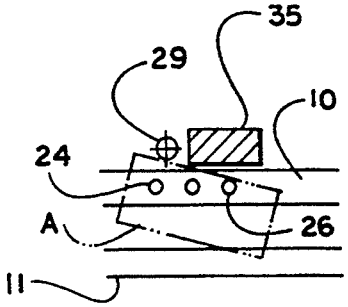

Looking at FIG. 5 of the drawings it will be noted that, as the article A rotates under the driving influence, more of the balls 24, 25 and 26 will engage the article to provide a greater driving force, thereby causing further turning of the article A. Even when the article A is removed from beneath the pivot device 29, the stanchion 35 will prevent motion of the article in the forward direction, so there will be a further rotating force on the article A to cause the article to be substantially aligned with the belts 10 and 11.

It will be remembered that, after the article A moves from the belts 10 and 11 to the belts 15 and 16, the article A will be urged against the fence 18 by the angled belts 15 and 16. As a result, the article A will be fully aligned with the fence 18. In this position, the article A is ready to have one or more tabs applied, and to have the tabs wrapped around the edge of the article, or sealed to the article.

Figure 7:
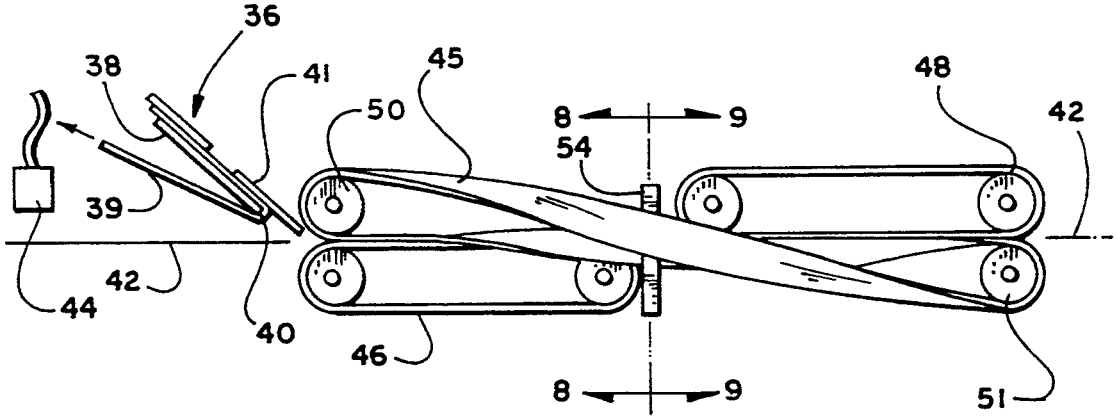
FIG. 7 is a front elevational view showing the tab application and sealing means made in accordance with the present invention.

Looking at FIG. 7 of the drawings, there is shown a tab application station generally designated at 36. The tab application station is of a type generally well know in the art, and many variations are possible. Those skilled in the art will readily select a tab applicator to suit the desired design. In general, there is a plate, or pin, 38 over which the release paper 39 passes. As the release paper 39 passes around the sharp end at 40, a tab 41 is stripped from the release paper 39. As the release paper 39 is pulled, on demand, in the direction of the arrow in FIG. 7, tabs 41 will be periodically supplied for application to articles passing along the path indicated at 42.

There is also shown in FIG. 7 a sensor 44 which may be a photoelectric cell or the like to indicate when an article is in position to have a tab applied. As is well known in the art, the information from the sensor 44 can be used to control the tab applicator 36 so tabs will be dispensed as required.

Figure 8:
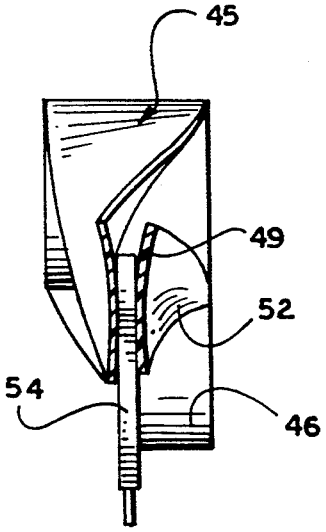
FIG. 8 is an enlarged cross-sectional view taken substantially along the line 8—8 in FIG. 7; and, FIG.9 is an enlarged cross-sectional view taken substantially along the line 9—9 in FIG. 7.
Figure 9:
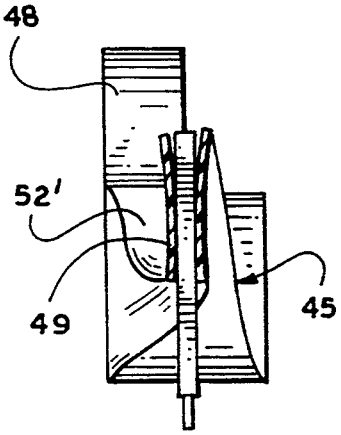

The apparatus illustrated in FIGS. 7, 8 and 9 is designed to wrap a tab around the edge of an article. The tab applicator 36 will dispense a tab 41 onto the edge of an article with generally half of the tab extending off the edge of the article. At this point, it is necessary to hold the tab against the edge of the article as the tab is applied to the article, until the tab extends beneath the article so that tab completely seals the edge of the article. Looking at FIG. 7, it will be seen that the tab extends under a twisted belt 45, the twisted belt 45 being above a pressure belt 46. The belt 45 holds the tab itself while the pressure belt 46 provides an opposed surface to seal the tab firmly against the article, the belts traveling at the same speed as the article.

At the right hand side of FIG. 7, it will be noted that there is a pressure belt 48 above the twisted belt 45, and the twisted belt 45 is now below the path 42. It should be understood that the twisted belt 45 has wrapped the tab around the edge of the article and sealed a portion of the tab to the bottom side of the article. The pressure belt 48, therefore, assists in sealing the complete tab to the article.

For a better understanding of the operation of the device shown in FIG. 7, attention is directed in FIGS. 8 and 9 of the drawings. FIG. 8 is cross-sectional view taken from approximately the center of the twisted belt 45 as indicted in FIG. 7, and looking towards the entrance end of the twisted belt 45. The center portion of the belt 45 provides a generally vertical line indicated at 49; however, this generally vertical line 49 is simply an intermediate line between the two opposite rollers 50 and 51. As is shown in FIG. 8, the twist of the belt 45 causes a warped, or curved surface 52.

Considering the fact that a tab 41 has been placed on the top of an article, and the tab 41 has been engaged by the belt 45 at the roller 50, the curve 52 in the belt 45 will cause the tab to curve downwardly until, at the generally vertical line 49, the tab will have been halfway rolled around the edge of the article.

Looking next at FIG. 9 of the drawings, it will be seen that the twisted belt 45 will complete the rolling of the tab 41 around the edge of the article. In FIG. 9, the generally vertical line 49 is again shown, and it will be seen that there is a curved portion of the belt designated at 52'. The curved portion of 52' is the opposite from the curved portion 52, so the tab 41 will be wrapped around the bottom surface of the article A. Finally, the article will pass between the belt 45 and the pressure belt 48.

Those skilled in the art will understand that, with the twisted belt 45 running as shown, the central portion of the belt would engage itself with considerable friction, and could cause excess heating and eventual damage to the belt 45. To lessen such damage, there is a spacer designated at 54. As here shown the spacer 54 comprises a coil spring carried by a spindle 55. The coil spring is desirable because of its flexibility, the spring being easily bendable to conform to the specific shape of the belts or the various forces applied thereto. The spring 54 is on the spindle 55 sufficiently loosely that the spring 54 can rotate. Since the two courses of the belt 45 move in opposite directions, it will be understood that the separator 54 will roll over the surfaces of the belt 45 to reduce the friction between the two courses of the belt.

From the foregoing description, it should now be understood that the present invention provides an extremely simple, yet fast and highly efficient apparatus and method for receiving articles, rotating the articles 90°, aligning one edge of the article, and applying a tab to the aligned edge. The turning device will receive a variety of thicknesses of article and efficiently turn the article and generally align the article with a predeterimined edge. An aligning section can complete the alignment for the precision desired; and, the tab dispensing and sealing section will place a tab tightly around the loose edge of the article. In conjuction with the tab sealing apparatus, there are pressure devices to assure that the tab is tightly sealed to the article.

It will of course be understood by those skilled in the art that the particular embodiment of the invention here presented is by way of illustration only, and is meant to be in no way restrictive; therefore, numerous changes and modifications may be made, and the full use of equivalents resorted to, without departing from the spirit or scope of the invention as outlined in the appended claims.

I claim:

1. Apparatus for applying a tab to an article for sealing an edge of the article, comprising conveying means for moving the article along a path, tab dispensing means above said path for dispensing a tab onto said article so that said tab extends about half off the surface of said article at said edge, and a warped surface adjacent to said path for resiliently engaging said tab and wrapping said tab around said edge to be sealed as said article moves along said path, wherein said warped surface comprises a continuous belt having a first course and a second course, said first course extending generally along said path and moving at the same speed as the article along said path, and being twisted to constitute said warped surface, said second course crossing said first course at an intersection, and being connected to said first course at each end thereof so that said continuous belt wraps said tab tightly around said edge of the article.

2. Apparatus as claimed in claim 1, and further including roller means between said first course and said second course at said intersection and disposed perpendicularly thereto, said roller means comprising an elongated flexible member rotatable with motion of said belt.

3. Apparatus as claimed in claim 1, wherein said warped surface includes an entrance end and an exit end, said entrance end lying above said path and said exit end lying beneath said path, and further including a first pressure belt beneath said path for pressing said article between said warped surface and said first pressure belt, and a second pressure belt lying generally above said path for pressing said article between said warped surface and said second pressure belt.

4. Apparatus as claimed in claim 3, and further including roller means between said first course and said second course at said intersection and disposed perpendicularly thereto, said roller means comprising an elongated flexible member rotatable with motion of said belt.

5. Apparatus for aligning an article with a fence and applying a tab to the article for sealing the edge of the article, said article being generally flat and rectangular, said apparatus comprising a stop, pivot means for engaging said article when said article is at said stop, driving means laterally displaced from said pivot means and said stop for engaging said article and exerting a driving force in a first direction for causing said article to pivot generally about said pivot means, a fence, means for aligning an edge of said article with said fence, and means for applying at least one tab to said edge, wherein said means for applying at least one tab to said edge comprises conveying means including a hold-down belt for holding the article and for moving the article along a path, tab dispensing means above said path for dispensing a tab onto said article so that said tab extends about half off the surface of said article at said edge, and a warped surface adjacent to said path for resiliently engaging said tab and wrapping said tab around said edge to be sealed as said article moves along said path, and wherein said warped surface comprises a continuous belt having a first course and a second course, said first course extending generally along said path and being twisted to constitute said warped surface, said second course crossing said first course at an intersection, and being connected to said first course at each end thereof, and further including roller means between said first course and second course at said intersection, and wherein said warped surface includes an entrance end and an exit end, said entrance end lying generally above said path and said exit end lying generally beneath said path, and further including a first pressure belt beneath said path for pressing said article between said warped surface and said first pressure belt, and a second pressure belt lying generally above said path for pressing said article between said warped surface and said second pressure belt.

6. Apparatus as claimed in claim 5, wherein said roller means comprises an elongated flexible member disposed perpendicularly to said continuous belt, and comprising an elongated flexible member rotatable with motion of said belt.

* * * * *